United States Patent [19]

Mori et al.

[11] 4,090,041

[45] May 16, 1978

[54] ELECTROMAGNETIC SONIC GENERATOR FOR AN ALARM

[75] Inventors: Shigeo Mori; Fumikazu Murakami; Yoshiaki Hara; Ichiro Horikoshi; Souya Takahashi, all of Tokyo, Japan

[73] Assignee: Kabushiki Kaisha Daini Seikosha, Japan

[21] Appl. No.: 753,849

[22] Filed: Dec. 23, 1976

[30] Foreign Application Priority Data

Dec. 24, 1975 Japan ..... 50-154297

[51] Int. Cl.[2] ..... H04R 11/02

[52] U.S. Cl. ..... 179/115 R; 179/120

[58] Field of Search ..... 179/114 R, 115 R

[56] References Cited

U.S. PATENT DOCUMENTS 1,738,653 12/1929 Inglis et al. ..... 179/115 R 2,078,385 4/1937 Kato ..... 179/115 R

*Primary Examiner*—George G. Stellar

*Attorney, Agent, or Firm*—Robert E. Burns; Emmanuel J. Lobato; Bruce L. Adams

[57] ABSTRACT

An electro-acoustic transducer of electromagnetic type is composed of an exciting part having a magnetic core wound with an exciting coil, a vibrating plate provided opposite to the magnetic core at an interval and a ferromagnetic thin plate mounted to the vibrating plate. The thin plate is provided on the surface of the vibrating plate on the side of the magnetic core, so that the thin plate is not exposed to the open air. Furthermore, the thin plate is connected to the vibrating plate at plural points more than three or at a part with some area. Such connection restrains undesirable vibration of the thin plate.

2 Claims, 10 Drawing Figures

ELECTROMAGNETIC SONIC GENERATOR FOR AN ALARM

BACKGROUND OF THE INVENTION

This invention relates to an electro-acoustic transducer of electromagnetic type and more particularly to an electro-acoustic transducer having the property of being not influenced by circumstances.

In an electronic alarm watch, an electro-acoustic transducer of electromagnetic type, which is used as an alarm generator, has an exciting part and a vibrating plate excited by it.

A conventional electro-acoustic transducer of electromagnetic type is shown in FIG. 1, as an example. An exciting part 1 is composed of a plate 2 which has a magnetic core 3 and is made of magnetic material, e.g., pure iron, an exciting coil 4 wound on the magnetic core 3 and a cylindrical permanent magnet 5 which is provided on the plate 2 to surround the exciting coil 4. This is received in a supporting body 6 which is made of non-magnetic material, e.g., brass. A vibrating plate 7, which is a flexible metal plate, the circumference of which is simply supported on the circular end of the supporting body 6, is provided oppositely to the magnetic core of the exciting part 1 at an interval. A thin plate 8, which is a ferromagnetic substance and is formed smaller than the vibrating plate 7, is connected to the vibrating plate 7. In this case, the thin plate 8 is connected to the surface of the vibrating plate 7 opposite to that on the side of the magnetic core 3, as shown in FIG. 2, at one point "*a*" in center by means of spot welding or the like. As the thin plate 8 is attracted to the side of the exciting part 1 by the magnetic attraction of the permanent magnet 5 of the exciting part 1, the circular end of the vibrating plate 7 placed merely on the top end of the supporting body 6 is pressed so as to be held to the supporting body 6. The vibrating plate 7 is bent, as shown in FIG. 3, as the thin plate 8 is attracted to the side of the exciting part 1. Accordingly, the circular end of the thin plate 8 is pressed to the vibrating plate 7 and the thin plate 8 itself is also bent, so that the one point connection at only the point "*a*" makes a sufficient connection between the thin plate 8 and the vibrating plate 7. The thin plate 8 does not operate independently as a rigid body but vibrates together with the vibrating plate 7 in the direction of X. In accordance with the foregoing, even if the connection between the vibrating plate 7 and the thin plate 8 is a spot one, it offers no problem for the function of the electro-acoustic transducer of electromagnetic type. As the thin plate 8 is connected to the surface of the vibrating plate 7 on the side opposite to the side of the exciting part 1, however, in case that the electro-acoustic transducer of electromagnetic type is used for an electronic alarm watch or the like, the thin plate 8 is directly exposed to the open air through sound releasing holes formed through a watch casing or the like. The thin plate 8 is generally made of pure iron. Since such a ferromagnetic substance offers a problem of corrosion resistance, it is undesirable to use a conventional electro-acoustic transducer of electromagnetic type for an electronic alarm watch or the like.

STATEMENT OF OBJECTS

It is an object of the invention to solve the problem of corrosion resistance of the thin plate which is connected to the vibrating plate and is made of ferromagnetic material.

It is another object of the invention to provide an electro-acoustic transducer of electromagnetic type which has the property of being not influenced by circumstances so that it may be used under any environment.

It is another object of the invention to provide a transducer which may restrain the undesirable vibration of the thin plate.

BRIEF DESCRIPTION OF DRAWINGS

These and other objects, features and advantages of the invention will become more apparent upon a reading of the following detailed specification and drawing, in which:

FIG. 9 is a plan view showing another connecting condition between the vibrating plate and the thin plate similar to that.

FIG. 10 is a plan view showing another connecting condition between the vibrating plate and the thin plate similar to that.

DETAILED DESCRIPTION

Figure 4:
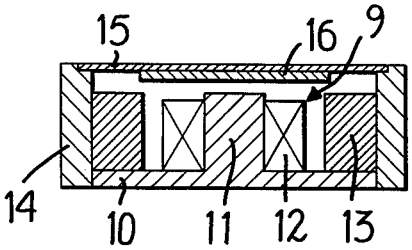
FIG. 4 is a vertical section showing an embodiment of the electro-acoustic transducer of electromagnetic type according to the invention.

Referring to FIG. 4 which shows an embodiment of the electro-acoustic transducer of electromagnetic type according of this invention, numeral 9 is an exciting part. This is composed of a plate 10 which has a magnetic core 11 in the center and is made of magnetic material, an exciting coil 12 wound on the magnetic core 11 and a cylindrical permanent magnet 13 which is provided on the plate 10 and surrounds the exciting coil 12. The exciting part 9 is received in a cylindrical supporting body 14. A vibrating plate 15, which is made of flexible metal, the circumference of which is simply or fixedly supported on the circular end of the supporting body 14, is provided oppositely to the magnetic core 11 of the exciting part 9. A thin plate 16, which is made of ferromagnetic substance and is formed smaller than the vibrating plate 15, is provided on the surface of the vibrating plate 15 on the side of the magnetic core 11.

Since the electro-acoustic transducer of electromagnetic type having such composition has the thin plate 16 which is provided on the surface of the vibrating plate 15 on the side of the magnetic core 11, when it is used for an electronic alarm watch or the like, for example, the thin plate 16 is prevented from being directly exposed to the open air, so that it is possible to prevent corrosion of the thin plate 16 being caused by the open air.

Figure 5:
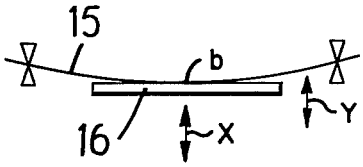
FIG. 5 is a view for explaining the connecting condition between the vibrating plate and the thin plate, the static transformation state of the vibrating plate and the vibrating direction at the time of exciting, in a case of one point connection.

The connection between the vibrating plate 15 and the thin plate 16 may be performed at one point "*b*" by means of spot welding, as shown in FIG. 5, for example, similarly to the case of conventional electro-acoustic transducer of electromagnetic type. In this case, however, as the thin plate 16 is attracted by the exciting part 9, the vibrating plate 15 is bent, so that a gap is formed between the part except the center of the thin plate 16 and the vibrating plate 15. At the time of exciting, the thin plate 16 vibrates in the direction of X together with the vibrating plate 15. On the other hand, the thin plate 16 operates as a rigid body independently of the vibrating plate 15 and vibrates in the direction of Y with a point "*b*" being a supporting point. The undesirable vibration in the direction of Y generated by the thin plate 16 interferes in the main vibration of the vibrating plate 15 in the direction of X and has a bad influence upon it.

In a severe case of that, the connecting part on the point "*b*" between the vibrating plate 15 and the thin plate 16 becomes weak. Consequently, it is possible that the connection between the vibrating plate 15 and the thin plate 16 may be separated.

Figure 1:
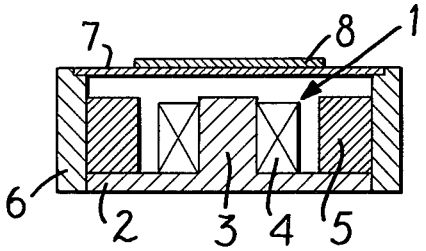
FIG. 1 is a vertical section showing a structure of a conventional electro-acoustic transducer of electromagnetic type.
Figure 2:
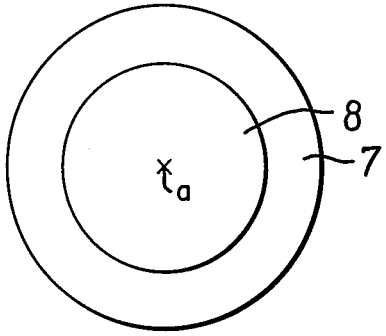
FIG. 2 is a plan view showing the connecting condition between the vibrating plate and the thin plate shown in FIG. 1.
Figure 3:
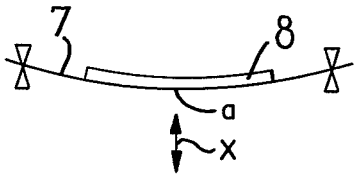
FIG. 3 is a view showing the static transformation state and the vibrating direction at the time of exciting of the vibrating plate shown in FIG. 1.
Figure 6:
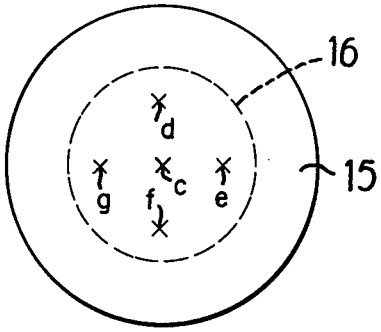
FIG. 6 is a plan view showing another connecting condition between the vibrating plate and the thin plate.
Figure 7:
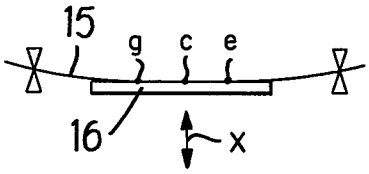
FIG. 7 is a view for explaining the static transformation state of the vibrating plate and the vibrating direction at the time of exciting, in the connecting condition shown in FIG. 6.

In order to avoid that, the thin plate 16 is spot-welded to the vibrating plate 15 at plural points "*c*", "*d*", "*e*", "*f*" and "*g*", as shown in FIG. 6. In such a case of connecting at plural points, the static transformation of the vibrating plate 15 has a bent state, as shown in FIG. 7, since the thin plate 16 is attracted by magnetic force of the exciting part 9. As the thin plate 16 is connected to the vibrating plate 15 at plural points, the relative position to the vibrating plate 15 is immovable, that is, unlike the case of connecting at one point, the thin plate 16 operates as not a rigid body, so that it is possible to restrain the undesirable oscillation mode in the direction of Y. Consequently, the thin plate 16 vibrates with the vibrating plate 15 in the direction of only X.

Figure 8:
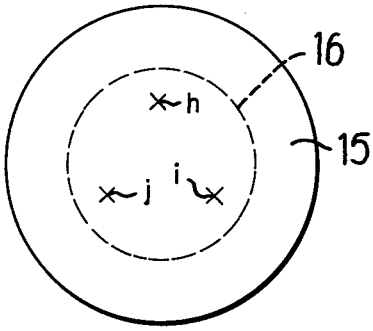
FIG. 8 is a plan view showing another connecting condition between the vibrating plate and the thin plate, in the electro-acoustic transducer of electromagnetic type according to the invention.

In the embodiment shown in FIG. 6, the thin plate 16 is connected to the vibrating plate 15 at five points in a spot state. However, even if the connection is performed at three points "*h*", "*i*" and "*j*", as shown in FIG. 8, similar effects may be expected. But, in a case of connecting at two points in a spot state, the thin plate vibrates undesirably with a supporting axis, which is a line connecting the two spots, and operates as a rigid body. In a case of connecting the vibrating plate 15 and the thin plate 16 in a spot state, therefore, it is necessary to perform at plural points more than three.

Figure 9:
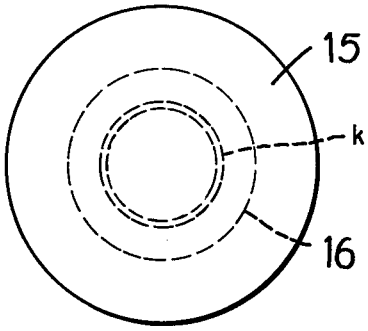
Figure 10:
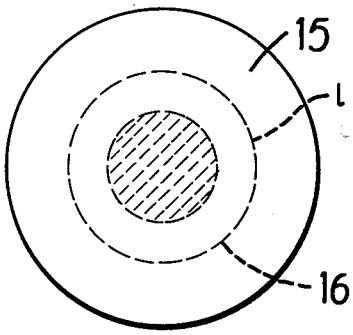

In the embodiments shown in FIG. 6 or FIG. 8, the thin plate 16 is connected to the vibrating plate 15 in a spot state. However, even if the connection is performed on a circular band line k which surrounds the center of the vibrating plate 15 and of the thin plate 16, using a bonding agent or the like, as shown in FIG. 9, similar effects may be obtained. This line "*k*" is not limited to a circle and it does not matter if it is another shape, e.g., a loop shape, a shape cut to pieces at plural position. It is possible, furthermore, to connect on a surface "*l*" using a bonding agent or the like, as shown in FIG. 10. When the thin plate 16 is connected to the vibrating plate 15 in not a spot state, i.e., in a state having some area, shown in FIG. 9 and FIG. 10, the thin plate 16 operates as not a rigid body independently of the vibrating plate 15 and the undesirable oscillation mode of the thin plate 16 is restrained, so that the main oscillation mode of the vibrating plate 15 becomes good.

In accordance with the foregoing, in the electro-acoustic transducer of electromagnetic type according to the invention, as the thin plate is provided on the surface of the vibrating plate on the side of the magnetic core of the exciting part, the thin plate made of ferromagnetic substance is covered to the open air by the vibrating plate, so that it is possible to prevent corrosion of the thin plate through the open air, to give the transducer the property of being not influenced by circumstances and to use the transducer anywhere.

By connecting the thin plate with the vibrating plate at plural points more than three or at the part which is not a spot and has some area, the undesirable vibration of the thin plate may be restrained, the main oscillation mode of the vibrating plate may not be interfered with by the undesirable vibration of the thin plate, the main oscillation mode becomes good, and the condition between the vibrating plate and the thin plate becomes firm, so that there is no risk of being disconnected.

As described hereinbefore, the electro-acoustic transducer of electromagnetic type has been explained in detail on the basis of the shown embodiments. The present invention, however, is not limited to the shown embodiment, and then various modifications and improvements may be made.

What is claimed is:

1. An electro-acoustic transducer for an alarm generator of the electromagnetic type comprising an exciting part which comprises a magnetic core and an exciting coil wound on said core, a vibrating plate mounted opposite to said magnetic core of said exciting part in spaced relation to said magnetic core and a thin plate of ferromagnetic material provided on the surface of said vibrating plate on the side thereof facing said magnetic core, said thin plate being smaller than said vibrating plate and being secured to said vibrating plate by welding at a plurality of spaced points more than three.

2. In an electronic alarm watch, an alarm generator comprising an electro-acoustic transducer of electromagnetic type comprising a base plate of magnetic material, a magnetic core projecting upwardly from the center of said base plate, an exciting coil wound on said core, a cylindrical permanent magnet provided on said base plate and surrounding said exciting coil, an annular body provided on said base plate and surrounding said permanent magnet and extending above said core and said permanent magnet, a vibrating plate of flexible metal supported at its circumference by said supporting body in spaced relation to said permanent magnet and said core and a thin plate of ferromagnetic material provided centrally on the inner face of said vibrating plate, said thin plate having a diameter larger than said exciting core and smaller than said vibrating plate and being secured to said vibrating plate by a plurality of spaced weld spots more than three, said base plate, supporting body and vibrating plate constituting an enclosure enclosing said thin plate to protect it from the atmosphere.

* * * * *